US009217592B2

(12) United States Patent
Turney et al.

(10) Patent No.: US 9,217,592 B2
(45) Date of Patent: Dec. 22, 2015

(54) METHOD AND APPARATUS FOR VARIABLE REFRIGERANT CHILLER OPERATION

(75) Inventors: Robert D. Turney, Watertown, WI (US); Justin P. Kauffman, Mount Wolf, PA (US); Kirk H. Drees, Cedarburg, WI (US); Homero Noboa, Waukesha, WI (US); Brett M. Lenhardt, Waukesha, WI (US)

(73) Assignee: Johnson Controls Technology Company, Holland, MI (US)

( * ) Notice: Subject to any disclaimer, the term of this patent is extended or adjusted under 35 U.S.C. 154(b) by 902 days.

(21) Appl. No.: 13/296,279

(22) Filed: Nov. 15, 2011

(65) Prior Publication Data

US 2012/0117989 A1 May 17, 2012

Related U.S. Application Data

(60) Provisional application No. 61/414,681, filed on Nov. 17, 2010.

(51) Int. Cl.
*F25B 45/00* (2006.01)
*F25B 1/00* (2006.01)
*F25D 17/02* (2006.01)

(52) U.S. Cl.
CPC ..... *F25B 45/00* (2013.01); *F25B 2500/19* (2013.01); *F25B 2700/04* (2013.01)

(58) Field of Classification Search
CPC ..... F25B 45/00; F25B 2345/001; F25B 2345/002; F25B 2345/006; F25B 2400/16; F25B 41/00; F25B 49/025; F25B 2600/021; F25B 27/00; B60H 1/00585; B60H 1/3208; Y02B 30/741
USPC ..... 62/149, 77, 174, 230
See application file for complete search history.

(56) References Cited

U.S. PATENT DOCUMENTS 3,264,841 A * 8/1966 Osborne ..... F25B 1/00 62/196.1
4,503,684 A * 3/1985 Mount ..... F04D 27/0246 415/14

(Continued)

FOREIGN PATENT DOCUMENTS

EP 0027604 A2 4/1981
EP 2051037 A2 4/2009

(Continued)

OTHER PUBLICATIONS

LG-ASHRAE Refrigerant Charge Calculation Formula, 2007, p. 2.*

(Continued)

*Primary Examiner* — Frantz Jules
*Assistant Examiner* — Meraj A Shaikh
(74) *Attorney, Agent, or Firm* — McNees Wallace & Nurick LLC

(57) ABSTRACT

A refrigeration system includes a compressor, a condenser, an expansion device, an evaporator, and an additional refrigerant vessel connected in a closed refrigerant loop. The additional refrigerant vessel is connected to the condenser at the high pressure side by a first valve and to the evaporator at a low pressure side by a second valve. A controller controls operation of the first valve and the second valve. Only one of the first valve and the second valve may be open at the same time. Refrigerant from the additional refrigerant vessel may be added to the closed refrigerant loop when the controller receives a low refrigerant level indication of in the evaporator. Refrigerant may also be removed from the closed refrigerant loop when the controller receives a high refrigerant level indication in the evaporator.

19 Claims, 8 Drawing Sheets

(56) References Cited

U.S. PATENT DOCUMENTS 5,207,074 A 5/1993 Cox et al.
5,706,665 A * 1/1998 Gregory ..... F25B 40/00 62/174
6,202,431 B1 * 3/2001 Beaverson ..... F04D 27/0207 62/196.3
6,209,338 B1 * 4/2001 Thatcher, Jr. ..... F25B 45/00 62/149
6,357,240 B1 * 3/2002 Zugibe ..... F25B 45/00 62/149
6,427,464 B1 * 8/2002 Beaverson ..... F04D 27/0207 62/129
6,691,525 B2 * 2/2004 Beaverson ..... F04D 27/0207 62/129
6,772,599 B2 * 8/2004 Bodell, II ..... F04D 27/0253 62/129
7,356,999 B2 * 4/2008 Bodell, II ..... F04D 27/0207 415/119
7,376,504 B2 * 5/2008 Zagranski ..... F02C 9/28 701/100
7,905,102 B2 * 3/2011 Bodell, II ..... F04D 27/0207 415/119
2002/0092318 A1 7/2002 Tipton et al.
2002/0170304 A1 * 11/2002 Beaverson ..... F04D 27/0207 62/228.3
2004/0025523 A1 * 2/2004 Bodell, II ..... F04D 27/0253 62/228.1
2004/0089015 A1 5/2004 Knight et al.
2004/0109757 A1 * 6/2004 Nenstiel ..... F04D 29/464 415/151
2005/0076656 A1 * 4/2005 Bodell, II ..... F04D 27/0207 62/83
2005/0160748 A1 * 7/2005 Shaffer ..... F01D 15/08 62/228.1
2006/0147301 A1 * 7/2006 Ueda ..... F04D 27/0207 415/144
2007/0277537 A1 * 12/2007 Parthasarathy ..... B64D 13/06 62/129
2008/0216491 A1 * 9/2008 Quest ..... F25B 49/005 62/77
2009/0025914 A1 1/2009 Knight et al.
2010/0162739 A1 7/2010 Kopko et al.
2011/0041523 A1 * 2/2011 Taras ..... F25B 9/008 62/77
2011/0126559 A1 6/2011 Kopko et al.
2012/0100011 A1 * 4/2012 Sommer ..... F04D 27/02 417/44.1

FOREIGN PATENT DOCUMENTS

WO 9964794 A1 12/1999
WO 2008150289 A1 12/2008
WO WO 2009058975 A1 * 5/2009 ..... F04D 17/12
WO 2010008960 A2 1/2010

OTHER PUBLICATIONS

LG-Understanding and Applying ASHRAE Standards, 2007, p. 2.*

* cited by examiner

METHOD AND APPARATUS FOR VARIABLE REFRIGERANT CHILLER OPERATION

CROSS-REFERENCE TO RELATED APPLICATIONS

This application claims the benefit of U.S. Provisional Application No. 61/414,681 entitled "METHOD AND APPARATUS FOR VARIABLE REFRIGERANT CHILLER OPERATION" filed Nov. 17, 2010, which application is hereby incorporated by reference in its entirety.

BACKGROUND

The present disclosure is directed to a method and apparatus for more efficient operation of a refrigeration system. More particularly, the disclosure relates to a method and apparatus for more efficient operation of a variable refrigerant chiller in the refrigeration system, which includes an additional refrigerant vessel to allow for variation of the amount of refrigerant in the refrigeration system.

Conventional chilled liquid systems in vapor compression refrigeration systems used in heating, ventilation and air conditioning systems include a condenser vessel, an evaporator vessel, a compressor, a variable speed drive (VSD), an expansion valve, and optionally a hot gas bypass valve. Operation of a chiller system produces chilled liquid (e.g. water) ($T_{ch}$) at varying load and cooling tower conditions. To efficiently produce $T_{ch}$, various compressor elements of the chiller system are employed.

In conventional refrigeration systems, the evaporator effects a transfer of thermal energy between the refrigerant of the system and another liquid to be cooled. As a result of the thermal energy transfer with the liquid, the heat is transferred into the refrigerant converting some of it into vapor, which is then returned to a compressor where the vapor is compressed, to begin another refrigerant cycle. The cooled liquid can be circulated to a plurality of heat exchangers located throughout a building. Warmer air from the building is passed over the heat exchangers where the cooled liquid is warmed, while cooling the air for the building. The liquid warmed by the building air is returned to the evaporator to repeat the process. During operation of the chiller, the liquid level is maintained in the chiller through a control loop utilizing the expansion (throttling) valve to control the height of the liquid level in the condenser vessel. The evaporator also has a mixture of liquid and gas refrigerant. The heat transfer characteristics in the evaporator are affected by the number of tubes "submerged" in the liquid refrigerant versus gas refrigerant.

Chiller operation is desired to control and produce $T_{ch}$ at a setpoint (e.g., 44 degrees F.) under different load conditions in the presence of disturbances such as low load scenarios, medium load scenarios, and high load scenarios. When considering a chiller for purchase there are load considerations that are used to estimate the peak load required to support the operation. This impacts the physical size of the chiller vessels, the number of tubes, size of compressor, and associated piping sizes. In addition, the refrigerant (e.g., R134a) charge is calculated based on the desired heat flux (BTU/hr*ft$^2$) in the refrigerant system.

Conventional chilled liquid systems provide a fixed amount of refrigerant in the system and thus are only optimized for one operating condition or state. Although conventional chiller systems are designed to run efficiently, over time, the chiller systems are often not running as efficiently as they could be due to fouling or other factors. Thus, there exists a need for chiller systems with variable refrigerant control.

Another situation that is to be avoided in conventional chilled liquid systems is surge. Surge or surging is an unstable condition that may occur during centrifugal compressor operation. Surge is a transient phenomenon having oscillations in pressures and flow, and results in complete flow reversal through the compressor. Surging, if uncontrolled, can cause excessive vibrations in both the rotating and stationary components of the compressor, and may result in permanent compressor damage. One common technique to correct a surge condition may involve the opening of a hot gas bypass valve to return some of the discharge gas of the compressor to the compressor inlet to increase the flow at the compressor inlet.

Therefore, what is needed is a high-efficiency chiller system that allows for efficient chiller operation and that prevents surge during low load conditions. The addition of a variable amount of refrigerant in the system enables another degree of freedom for operation of the chiller by changing the heat transfer characteristics and refrigerant level in the evaporator vessel.

SUMMARY OF THE INVENTION

The present disclosure is directed to a refrigeration system including a compressor, a condenser, an expansion device, an evaporator, and an additional refrigerant vessel connected in a closed refrigerant loop. The present disclosure provides an additional refrigerant vessel that is connected directly to the condenser and directly to the evaporator. Alternately, the additional refrigerant vessel is connected to the existing piping between the condenser and evaporator, usually the expansion valve line. This novel refrigeration system comprises an input valve from the condenser vessel, an additional refrigerant vessel to hold refrigerant, and an output valve to the evaporator vessel. The operation of the valves during a change in refrigerant amount is such that only one valve is open at a time to allow additional refrigerant to enter or be removed from the closed-loop system. If there is no change in refrigerant amount required then both of the valves are closed.

In one embodiment, a refrigeration system is disclosed. The refrigeration system includes a compressor, a condenser, an expansion device, an evaporator, and an additional refrigerant vessel connected in a closed refrigerant loop. The additional refrigerant vessel is connected to the condenser at a high pressure side by a first valve and to the evaporator at a low pressure side by a second valve. A controller controls operation of the first valve and the second valve. Only one of the first valve and the second valve may be open at the same time, to allow additional refrigerant to be added to the closed refrigerant loop when the controller receives a low refrigerant level indication in the evaporator, or to remove refrigerant when the controller receives a high refrigerant level indication of a refrigerant level in the evaporator.

In another embodiment, a method is disclosed for controlling cooling capacity of a chiller system. The chiller system includes having a compressor, a condenser and an evaporator connected in a closed refrigerant loop. The method includes providing a refrigerant vessel for a chiller system; connecting the refrigerant vessel and an outlet line from the refrigerant vessel to the evaporator; connecting an inlet line to the refrigerant vessel to the condenser, the inlet line including a first valve to control flow of refrigerant in the inlet line and the outlet line including a second valve to control flow of refrigerant in the outlet line; monitoring a parameter associated with the compressor for indication of a surge condition in the chiller system; in response to receiving an indication of an impending surge condition, observing a refrigerant liquid level in the evaporator with respect to surge indication frequency, and adjusting the capacity of the chiller system in response to a change in the refrigerant liquid level in the evaporator.

Another feature of the present disclosure is a method for storing refrigerant in a chiller system, wherein the method includes: opening the outlet valve attached to the evaporator so the pressure in the additional refrigerant vessel is at low evaporator value (e.g., 40 psig), next the outlet valve is closed and the inlet valve next to the condenser is opened for a period of time to move refrigerant at a higher pressure (e.g., 100 psig) to the refrigerant vessel. This method will result in less refrigerant being available to the chiller system and also changes the heat transfer characteristics in the evaporator. During the winter a minimum portion of the refrigerant will be stored in the refrigerant vessel to support part load and in the fall/spring it is expected that the refrigerant stored in the additional refrigerant vessel will increase. During high load conditions or summer months the refrigerant stored in the additional vessel will increase further to provide additional cooling capacity. To move refrigerant into the additional refrigerant vessel, the inlet valve next to the condenser is opened for a period of time to move the refrigerant to the refrigerant tank.

Efficient operation of multiple chillers with VSD drives indicates that operating several chillers at part load is more efficient than operating fewer chillers at full load. Running a chiller at part load limits the RPM of the VSD (generally 30 Hz), which results in the chiller generally running at a lower load condition. When the chiller unit is running at a lower load condition, the chiller unit is more likely or may have a tendency to surge. Surging should be avoided and this system removes additional refrigerant from the chiller system when the additional cooling capacity is not needed, thereby assisting in avoiding surge conditions. Adding refrigerant will decrease compressor head pressure and increase volume flow rate which helps avoid surge at a given RPM speed.

An advantage of the present disclosure is that it can be utilized to reduce the number of chiller geometrical variations required to support different load conditions. Another advantage is that by varying the amount of refrigerant and subsequently the heat transfer characteristics, operation of the chiller can be maintained with potentially lower building loads.

A further advantage is seasonal deployment of the variable refrigerant system (3-4 months frequency). During summer months when a fuller load operation is desired, less refrigerant will be deployed into the chiller system. During the fall/spring a portion of the refrigerant will be stored in the refrigerant vessel and in the winter the refrigerant in the refrigerant vessel will decrease to support part load and avoid surge in low load scenarios.

A further advantage of the present disclosure is that it provides a greater efficiency of chiller operation at part load, thus providing a secondary method to prevent surge or control against surge in the system.

Still a further advantage of the present disclosure is that it provides for a significant annualized energy efficiency improvement over current HVAC systems.

Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to refer to the same or like parts.

DETAILED DESCRIPTION

Figure 1:
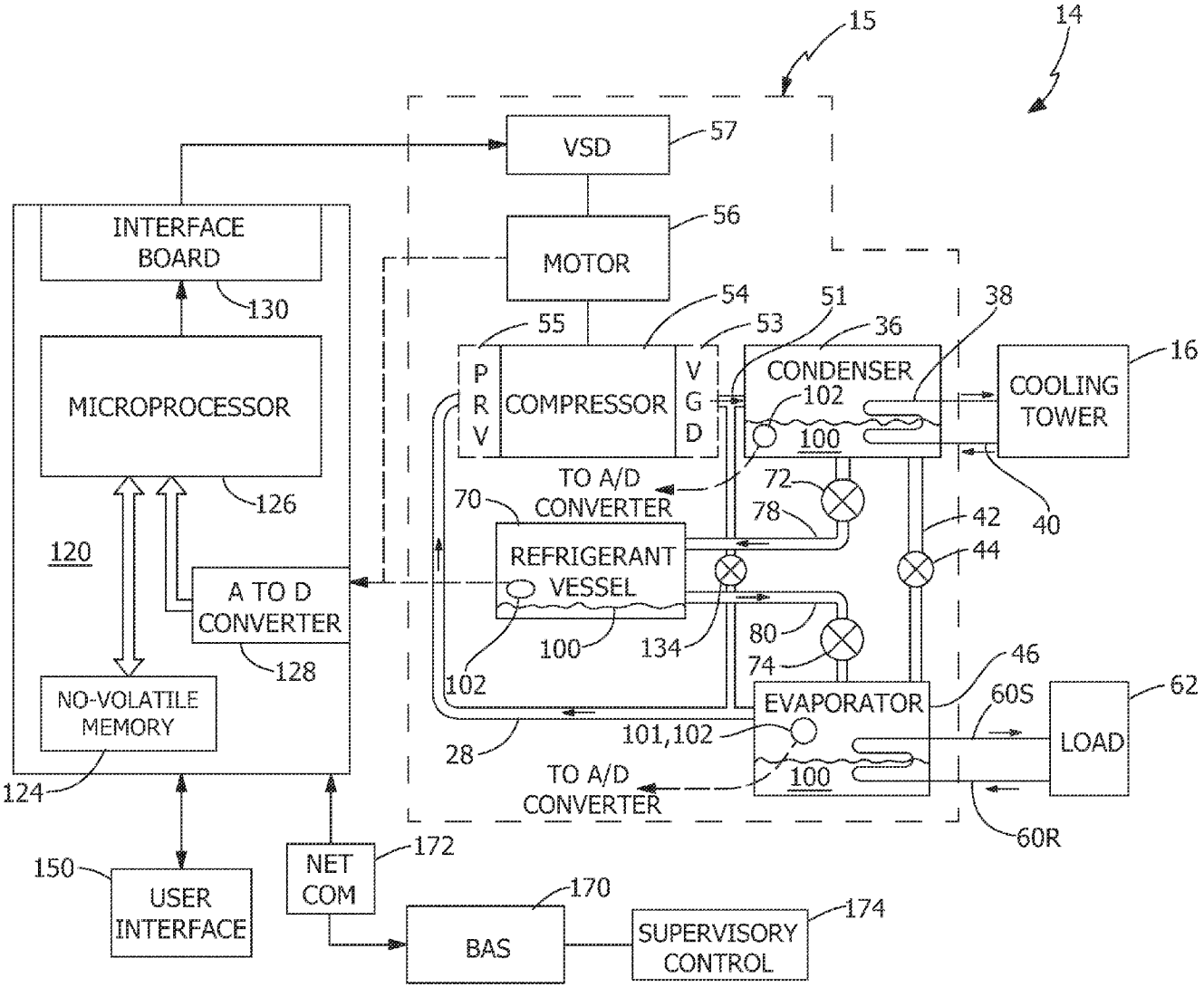
FIG. 1 schematically illustrates an exemplary embodiment of the refrigeration system of the present disclosure.

FIG. 1 depicts a Heating, Ventilating, and Air Conditioning (HVAC) system 10 that is typically installed in a building (not shown). The HVAC system 10 includes a cooling tower 16 positioned on the roof of the building. In an exemplary embodiment, cooling tower water is supplied to cooling tower 16 from a condenser 36 by a cooling tower supply line 38, and cooling tower return water is returned to condenser 36 by cooling tower return line 40. Condenser 36 is also connected to an evaporator 46, and to a refrigerant vessel 70, the operation of which is discussed in detail below. Refrigerant circulates as a gas from a compressor 54, driven by a motor 56 through refrigerant line 58 to condenser 36 where it undergoes a change of state and is condensed to a liquid. Although compressor 54 is depicted as a single compressor, a closed-loop chiller system 15 may include a plurality of compressors 54 operating in series, in which refrigerant gas flows from a first compressor to a second compressor and so forth prior to circulation to condenser 36, or in parallel, in which the refrigerant gas is split between multiple compressors 54 prior to being circulated to condenser 36. Heat is removed from the refrigerant gas in condenser 36, cooling the refrigerant to a first temperature $T_1$ by heat exchange with water from the closed loop system connected to heat exchanger 30. The water in the closed-loop system then circulates to heat exchanger 30, where heat is removed convectively from the water by air.

Motor 56 used with compressor 54 can be powered by a variable speed drive (VSD) 57 or can be powered directly from an alternating current (AC) or direct current (DC) power source (not shown). VSD 57, if used, receives AC power having a particular fixed line voltage and fixed line frequency from the AC power source and provides power having a variable voltage and frequency to motor 56. Motor 56 can include any type of electric motor that can be powered by a VSD or directly from an AC or DC power source. For example, motor 56 can be a switched reluctance motor, an induction motor, an electronically commutated permanent magnet motor or any other suitable motor type. In an alternate exemplary embodiment, other drive mechanisms such as steam or gas turbines or engines and associated components can be used to drive compressor 54.

In one embodiment, compressor 54 is a centrifugal compressor. In another embodiment compressor 54 is a, screw compressor, reciprocating compressor, rotary compressor, swing link compressor, scroll compressor, turbine compressor, or any other suitable compressor. The refrigerant vapor delivered by compressor 54 to condenser 36 transfers heat to a fluid, for example, water. The refrigerant vapor condenses to a refrigerant liquid in condenser 36 as a result of the heat transfer with the fluid. In the exemplary embodiment, condenser 36 is water cooled and includes a cooling tower supply line and a cooling tower return line connected to cooling tower 16. The liquid refrigerant from condenser 36 flows through expansion valve 44 to evaporator 46. In one exemplary embodiment, a liquid chamber 101 may be in placed in fluid communication with evaporator 46 interior on an outer wall of evaporator 46, and used to facilitate the measuring of liquid level in the evaporator by sensor 102. Chamber 101 provides a region in the evaporator that is separate from the boiling area so that liquid refrigerant will be present.

Figure 2:
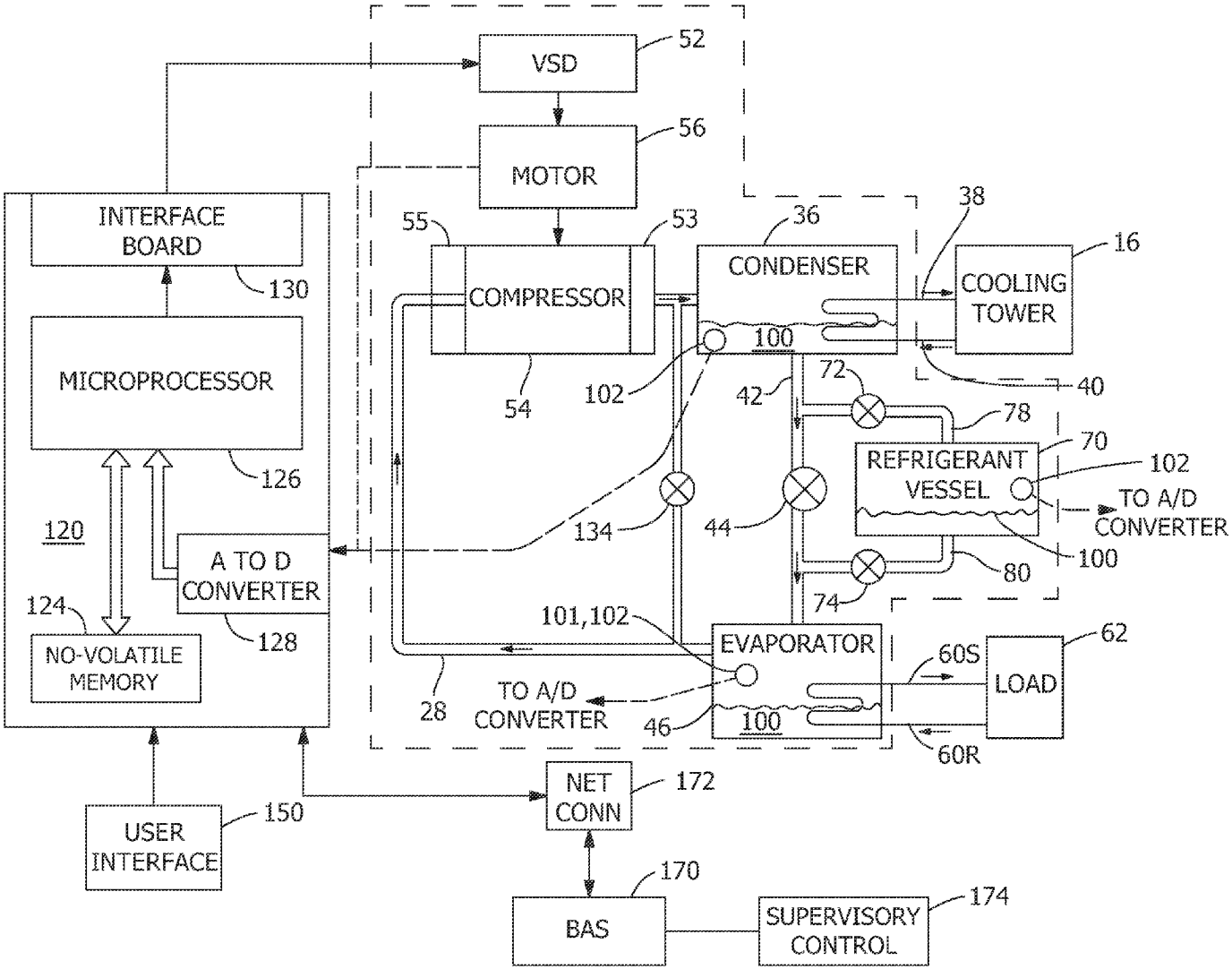
FIG. 2 schematically illustrates another exemplary embodiment of the refrigeration system of the present disclosure.
Figure 4:
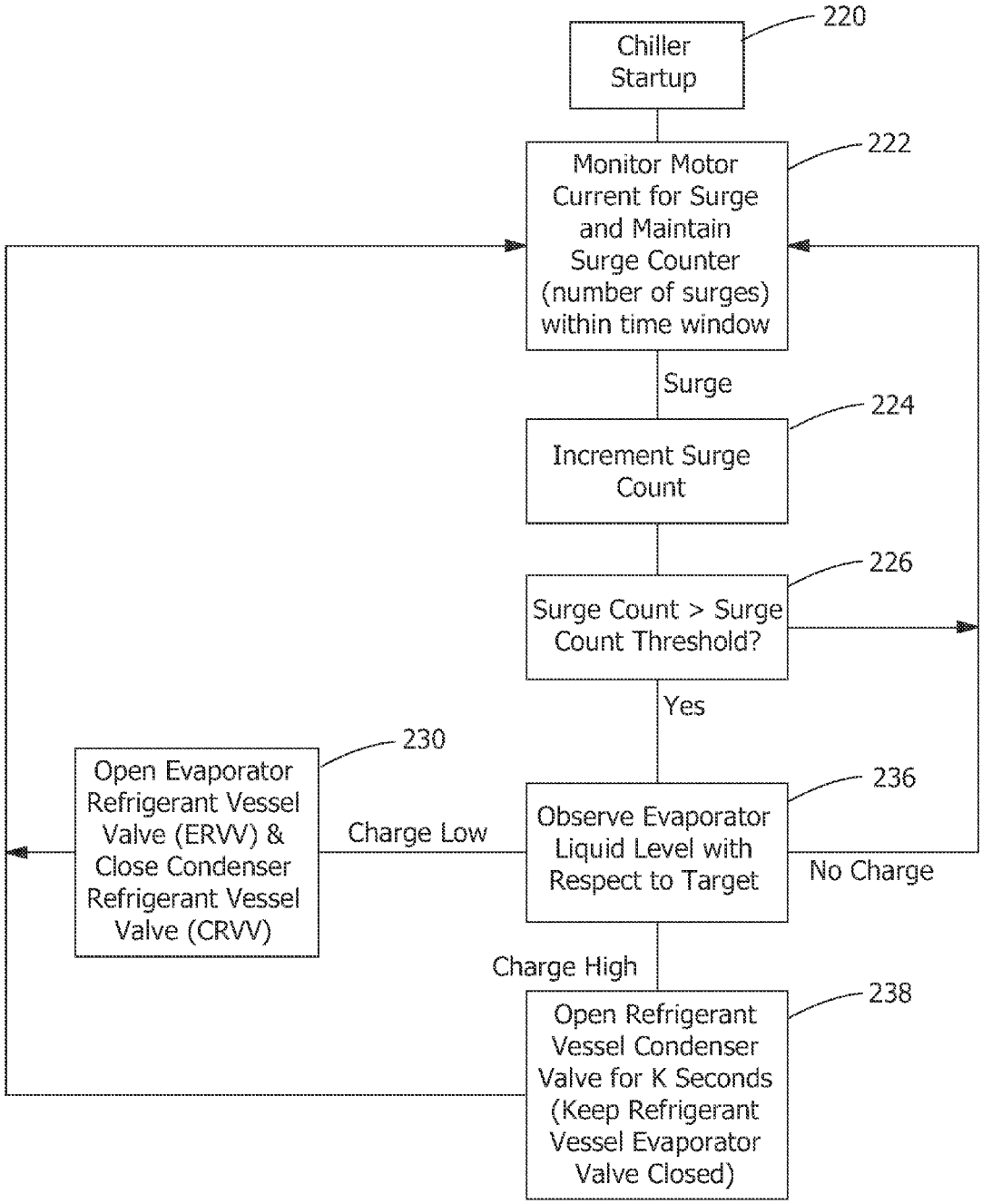
FIG. 4 illustrates an exemplary embodiment of a control method for anti-surge operation of a chiller system.

As shown in FIGS. 2 and 4, an additional refrigerant vessel 70 is present to vary the amount of refrigerant 100 in the closed-loop chiller system 15 of vapor compression system 14 to satisfy reduced load requirements during seasonal peaks, and prevent surge at low load conditions, by reducing the amount of refrigerant stored in during off-peak or cold months.

In one embodiment, as shown in FIG. 2, during the winter months most or all of additional refrigerant 100 in refrigerant vessel 70 will be deployed into closed-loop chiller system 15 to prevent surge at low load conditions. During the fall and spring months refrigerant from closed-loop chiller system 15 will be stored in refrigerant vessel 70 with additional refrigerant 100 (see FIG. 1). During the summer months excess refrigerant will also be stored in refrigerant vessel 70. In the present embodiment, the amount of refrigerant may be varied, which subsequently varies the heat transfer characteristics in the closed-loop chiller system, therefore allowing operation of the closed-loop chiller system 15 to be maintained with potentially lower building cooling loads. In FIG. 2, refrigerant vessel 70 is connected directly to condenser 36 by a first line 78 having an input valve 72 and connected directly to evaporator 46 by a second line 80 having an output valve 74. The operation of the input valve 72 and output valve 74 is such that only one of the two valves 72, 74 is open at a time between refrigerant vessel 70 and either condenser 36 and/or evaporator 46. If there is no change in refrigerant amount required then both input valve 72 and output valve 74 are closed.

In an alternative embodiment, as shown in FIG. 4, refrigerant vessel 70 is connected to the expansion valve line 42, which connects to both condenser 36 and evaporator 46, by a first line 78 and a second line 80.

Once additional refrigerant 100 is introduced into the closed-loop chiller system 15, the refrigerant is delivered to evaporator 46. The evaporator 46 absorbs heat from another fluid, which may or may not be the same type of fluid used for condenser 36, and undergoes a phase change to a refrigerant vapor. In the exemplary embodiments shown in FIGS. 2 and 4, evaporator 46 includes a tube bundle having a supply line 60S and a return line 60R connected to a cooling load 62. A process fluid, for example, water, ethylene glycol, calcium chloride brine, sodium chloride brine, or any other suitable liquid, enters evaporator 46 via return line 60R and exits evaporator 46 via supply line 60S. Evaporator 46 chills the temperature of the process fluid. The tube bundle in evaporator 46 can include a plurality of tubes and a plurality of tube bundles. The vapor refrigerant exits evaporator 46 and returns to compressor 54 by a suction line 28 to complete the cycle. Refrigerant at temperature $T_1$ is further cooled in condenser 36 after cooling to temperature $T_2$ by water from cooling tower 16, provided by cooling water return line, which may be supplemented by water from cooling tower return water replenishment line 61 (see FIG. 1).

Figure 3:
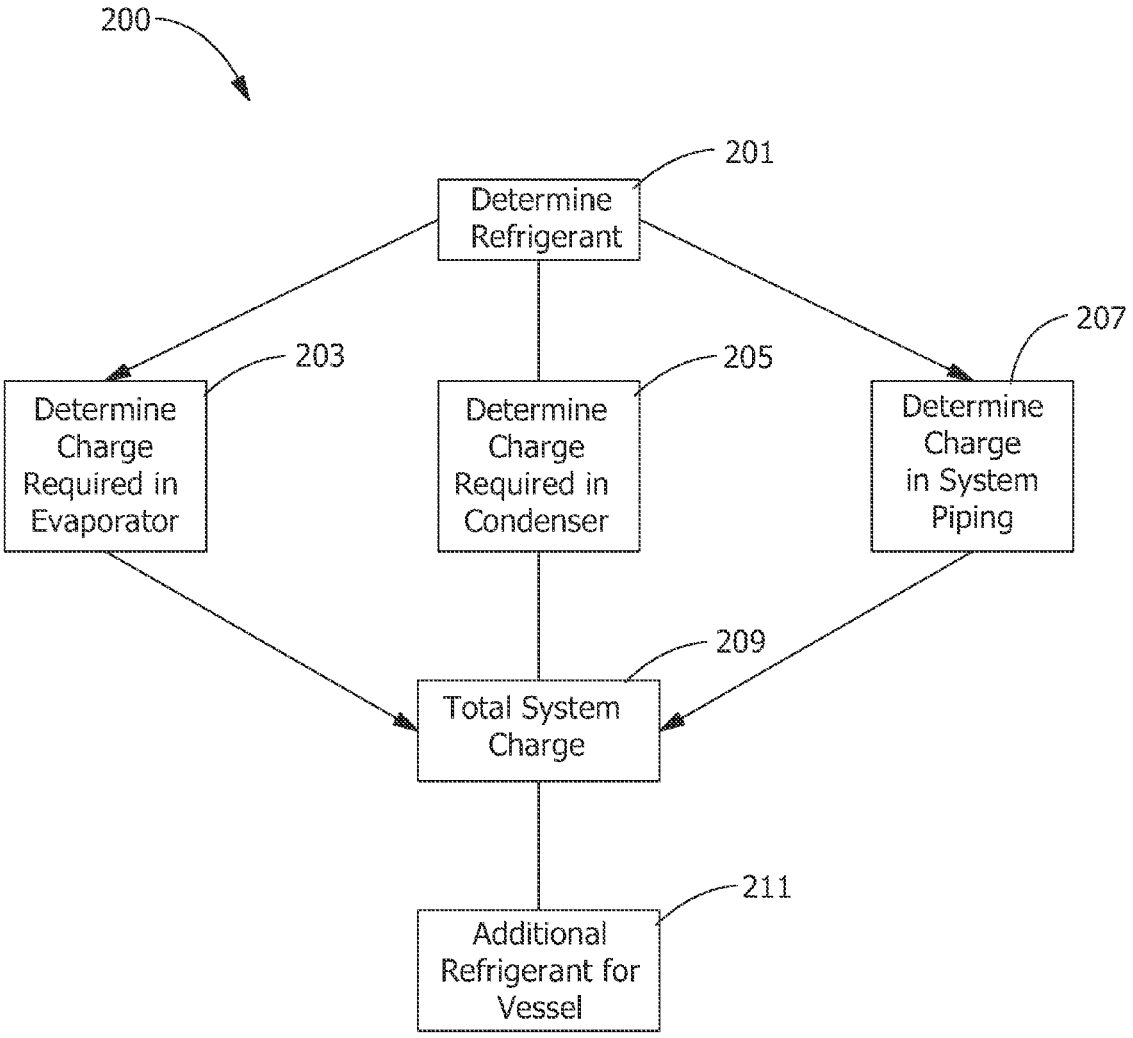
FIG. 3 is a block diagram of an exemplary method for calculating the refrigerant in the refrigerant vessel.

As shown in FIG. 3, in the illustrated embodiment, a Modified Refrigerant Charge Calculation Method (MRCCM) may be used to determine an amount of the additional refrigerant 100 to provide in refrigerant vessel 70. Refrigerant vessel 70 can be sized using a minimum and maximum amount of refrigerant in the chiller system and taking the difference between the two amounts as the amount to be stored in the refrigerant vessel. A method 200 for determining the amount of additional refrigerant 100 for additional refrigerant vessel 70 is described as follows. To begin, at box 201 the type of refrigerant being used is provided. If the refrigerant type is not already known it must be determined at box 201. Some examples of fluids that may be used as refrigerants in closed chiller system 15 are hydrofluorocarbon (HFC) based refrigerants, for example, R-410A, R-134a, hydrofluoro olefin (HFO) R1234yf, water vapor or any other suitable type of refrigerant. Next, in any order, at box 203 the refrigerant charge required in the evaporator must be determined, at box 205 the refrigerant charge required in the condenser must be determined, and at box 207 the refrigerant charge required in the system piping must be determined. To determine the refrigerant charge in the evaporator (box 203) equation 1 is used:

$$\text{Charge}_{evap}=LF_{evap}\times\rho_{liq.evap}\times\text{Volume}_{evap} \qquad \text{Equation 1}$$

Where the refrigerant charge in the evaporator ($\text{Charge}_{evap}$) is calculated by multiplying the loading factor of the evaporator ($\text{LF}_{evap}$) by the fluid density of the evaporator ($\rho_{liq.evap}$) by the volume of the evaporator ($\text{Volume}_{evap}$). To determine the refrigerant charge in the condenser (box 205) equation 2 is used:

$$\text{Charge}_{cond}=\rho_{liq.cond}\times\text{Vol}_{sub}+\rho_{cond.equiv}\times\text{Vol}_{cond} \qquad \text{Equation 2}$$

Where the refrigerant charge in the condenser ($\text{Charge}_{cond}$) is calculated by multiplying the fluid density of liquid in the condenser ($\rho_{liq.cond}$) by volume of the liquid in the subcooler ($\text{Vol}_{sub}$) and adding this product to the product of equivalent fluid density in the condenser ($\rho_{cond.equiv}$) and the volume of fluid the condenser ($\text{Vol}_{cond}$). To determine the refrigerant charge in the system piping (box 207) equation 3 is used:

$$\text{Charge}_{piping}=F_{piping}\times(\text{Charge}_{evap}+\text{Charge}_{cond}) \qquad \text{Equation 3}$$

Where the refrigerant charge in the system piping ($\text{Charge}_{piping}$) is calculated by multiplying a factor ($\text{F}_{piping}$) representing refrigerant charge in the system piping, which is assumed to be approximately 13% of the total shell charge, by the sum of the charge in the evaporator ($\text{Charge}_{evap}$) and the refrigerant charge in the condenser ($\text{Charge}_{cond}$). Once refrigerant charge in the evaporator is determined at box 203, the refrigerant charge required in the condenser is determined at box 205, and the refrigerant charge required in the system piping is determined at box 206, the total system refrigerant charge (box 209) can be determined. To determine the total system refrigerant charge (box 209) equation 4 is used:

$$\text{Charge}_{total}=\text{Charge}_{evap}+\text{Charge}_{cond}+\text{Charge}_{piping} \qquad \text{Equation 4}$$

Where total system charge ($\text{Charge}_{total}$) is calculated by summing the charge in the evaporator ($\text{Charge}_{evap}$) and the charge in the condenser ($\text{Charge}_{cond}$) and the charge in the system piping ($\text{Charge}_{piping}$). The calculated total system charge is used to determine the amount of refrigerant (box 211) to add to refrigerant vessel 70 to achieve the desired properties for the HVAC system 10.

Refrigerant vessel 70 can be added to existing HVAC systems 10 with minimal effort by connecting refrigerant vessel 70 to expansion valve line 42 between condenser 36 and evaporator 46. Refrigerant vessel 70 can also be designed and implemented into new HVAC systems 10 by connecting the refrigerant vessel 70 directly to condenser 36 and evaporator 46 or optionally, connecting refrigerant vessel 70 to expansion valve line 42. The above MRCCM calculation can be used to determine the amount of additional refrigerant 100 to be charged into refrigerant vessel 70 to provide modified cooling capacity for closed-loop chiller system 15.

As shown in FIGS. 2 and 4, chiller equipment controller 120 is in communication with a network connection 172 and Building Automation System (BAS) 170, which monitors and controls the overall HVAC system 10. Chiller equipment controller 120 uses a control algorithm(s) to control operation of closed-loop chiller system 15 and to determine when to respond to particular compressor conditions, condenser conditions, and evaporator conditions, in order to maintain closed-loop chiller system 15 stability which, includes preventing stall and surge conditions. Additionally, chiller equipment controller 120 can use the control algorithm(s) to open and close the optional, hot gas bypass valve (HGV) 134, if present, in response to particular compressor conditions in order to maintain system and compressor stability. In one embodiment, the control algorithm(s) can be computer programs stored in non-volatile memory 124 having a series of instructions executable by microprocessor 126. While the control algorithm can be embodied in a computer program(s) and executed by microprocessor 126, it will be understood by those skilled in the art that the control algorithm may be implemented and executed using digital and/or analog hardware. If hardware is used to execute the control algorithm, the corresponding configuration of chiller equipment controller 120 can be changed to incorporate the necessary components and to remove any components that may no longer be required, for example, A/D converter 128.

Chiller equipment controller 120 may include analog to digital (A/D) and digital to analog (D/A) converters 128, microprocessor 126, non-volatile memory or other memory device 124, and interface board 130 to communicate with various sensors and control devices of closed-loop chiller system 15. In addition, chiller equipment controller 120 can be connected to or incorporate a user interface 150 that permits an operator to interact with chiller equipment controller 120. The operator can select and enter commands for chiller equipment controller 120 through user interface 150. In addition, user interface 150 can display messages and information from chiller equipment controller 120 regarding the operational status of closed-loop chiller system 15 for the operator. The user interface 150 can be located on or near chiller equipment controller 120, such as being mounted on chiller equipment controller 120, or alternatively, user interface 150 can be located remotely from chiller equipment controller 120, such as being located in a separate control room apart from closed-loop chiller system 15.

Microprocessor 126 may execute or use a single or central control algorithm or control system to control closed-loop chiller system 15 including compressor 54, condenser 36, evaporator, refrigerant vessel 70, and inlet valve 72 and outlet valve 74 from refrigerant vessel 70. In one embodiment, the control system can be a computer program or software having a series of instructions executable by microprocessor 126. In another embodiment, the control system may be implemented and executed using digital and/or analog hardware by those skilled in the art. In still another embodiment, chiller equipment controller 120 may incorporate multiple controllers, each performing a discrete function, with a central controller that determines the outputs of chiller equipment controller 120. If hardware is used to execute the control algorithm, the corresponding configuration of chiller equipment controller 120 can be changed to incorporate the necessary components and to remove any components that may no longer be required.

Chiller equipment controller 120 of closed-loop chiller system 15 can receive many different sensor inputs from the components of closed-loop chiller system 15. Some examples of sensor inputs to chiller equipment controller 120 are provided below, but it is to be understood that chiller equipment controller 120 can receive any desired or suitable sensor input from a component of closed-loop chiller system 15. Some inputs to chiller equipment controller 120 relating to refrigerant vessel 70 can be from input valve sensor, output valve sensor, fluid level sensor 102 in refrigerant vessel 70, pressure sensor in condenser 36, pressure sensor in evaporator, fluid level sensor 102 in condenser, and fluid level sensor 102 in evaporator 46.

The central control algorithm executed by microprocessor 126 on chiller equipment controller 120 preferably includes a refrigerant control program or algorithm to control the amount of refrigerant 100 introduced into or removed from refrigerant vessel 70 to run efficiently and prevent surge. The refrigerant control program can automatically determine by monitoring the load conditions and surge conditions the desired amount of additional refrigerant 100, to add into closed-loop chiller system 15 to allow for higher efficiency operation of the condenser 36 and evaporator 46.

The refrigerant control program can be configured to maintain selected parameters of closed-loop chiller system 15 within preselected ranges. These parameters include input valve position (open/closed), output valve position (open/closed), fluid level in the refrigerant vessel, fluid level in condenser, and fluid level in evaporator. The refrigerant control program may employ continuous feedback from sensors monitoring various operational parameters described herein to continuously monitor and change the amount of refrigerant 100 in closed-loop chiller system 15, in response to changes in system cooling loads. That is, as closed-loop chiller system 15 requires either additional or reduced cooling capacity, the amount of refrigerant 100 in the closed-loop chiller system 15 can be varied by opening or closing inlet valve 72 or outlet valve 74 to refrigerant vessel. Existing capacity control methods, e.g., pre-rotation vanes (PRV) 55 at compressor suction line 28, or a variable geometry diffuser 53 positioned at compressor discharge line 51, RPM of compressor 54 and evaporator 46 in closed-loop chiller system 15 are correspondingly updated or revised in response to changes in cooling capacity capabilities, as a result of the modified refrigerant 100 amount.

In addition to the refrigerant control program, (BAS) 170 provides additional parameters to allow the HVAC system 10 maintain maximum operating efficiency. BAS 170 includes a supervisory controller 174 and a network connection 172 to chiller equipment controller 120. Supervisory controller 174 controls chilled water temperature setpoint, turns the chiller system 15 on or off, and determines how the chiller system 15 should run based on time of day, date, season, or any other forward looking profile that is provided to the supervisory controller 174. Network connection 172 communicates information between BAS 170 and closed-loop chiller system 15. Network connection 172 relays information to BAS 170 from closed-loop chiller system 15 about operating conditions of closed-loop chiller system 15 such as chilled water set point, current limit (between 0-100 percent usage), and amount of refrigerant in closed-loop chiller system 15. BAS 170 can control specific components in closed-loop chiller system 15 through the chiller equipment controller 120. Chiller equipment controller 120 monitors and controls the chiller system components, such as the compressor 54, condenser 56, and evaporator 46, and amount of refrigerant 100 from refrigerant vessel 70 in the closed-loop chiller system 15. BAS 170 provides non-local, or temperature and pressure independent feedback and data to the chiller equipment controller 120. BAS 170 provides information acquired from sources that are not available to the local chiller equipment controller 120 such as number of occupants in building 12, type of day (i.e., sunny, cloudy, windy), weather predictions looking forward, and information on other chillers in the system that may be coming online or turning off. BAS 170 provides information and input to chiller equipment controller 120 to operate efficiently based on non-local parameters such as number of occupants, type of day, etc., thereby making operation of the vapor compression system 14 more efficient annually due to charge management system proposed.

Referring to FIG. 4, a method of controlling anti-surge in chiller system 15 is described as follows. At box 220, the chiller startup is completed. Next the method proceeds to box 222 and monitors motor current for an indication of surge. The system maintains a surge counter to count the number of surges occurring within a time window. When at box 222 a surge is indicated, the method proceeds to box 224 and increments a surge count. Next, at box 226, the method compares the cumulative surge count with a surge count threshold. If the surge count is less than or equal to the surge count threshold, the method returns to box 222. Otherwise, the method proceeds to box 236, to observe the liquid refrigerant level in evaporator 46 with respect to a target refrigerant level. If no change is observed in the liquid refrigerant level in evaporator 46 over the predetermined interval, then the system returns to box 222 to monitor motor current for surge indication. At box 236 again, if the evaporator 46 liquid refrigerant level is too high, then the method proceeds to box 238. At box 238, the controller 120 opens valve 72 between refrigerant vessel 70 and condenser 36 for a predetermined interval, and maintains valve 74 closed between evaporator 46 and refrigerant vessel 70. At the end of the predetermined interval valve 74 is closed and the method returns to box 222 to resume monitoring motor current for surge condition. Returning to box 236, in the event that the refrigerant level in the evaporator is indicating too low, the method proceeds to box 230, and valve 74 is opened to permit refrigerant flow from refrigerant vessel 70 into evaporator 46, and valve 72 is closed, causing additional refrigerant from refrigerant vessel 70 to flow back into the refrigerant circuit.

Figure 5:
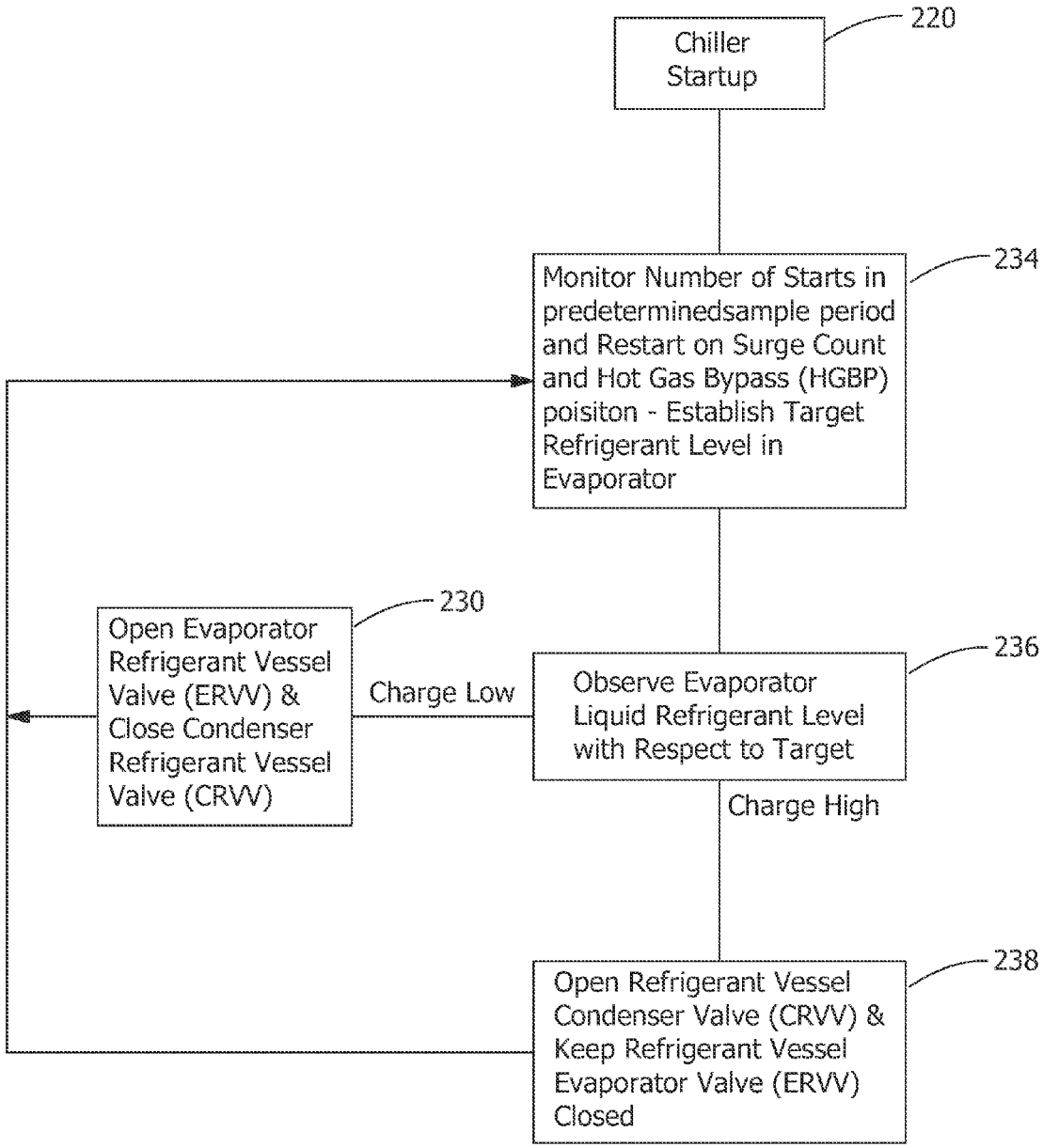
FIG. 5 illustrates an alternate exemplary embodiment of a control method for recycling refrigerant in low load conditions of a chiller system.

Referring next to FIG. 5, an alternate embodiment of a control method is shown, for reducing low load recycling of chiller system. The control method of FIG. 5 begins at box 222 with the chiller system startup. After the chiller system startup at box 222 is completed, the control method proceeds at box 234 to monitor the number of start cycles occurring over a predetermined interval, e.g., 24 hours, and the number of chiller system restarts occurring over the same interval on surge count and hot gas bypass valve position, to establish a target refrigerant level for liquid refrigerant in evaporator 46. Next, at box 236, the system observes the liquid refrigerant level in evaporator 46 with respect to the target refrigerant level previously established. If the liquid refrigerant level in evaporator 46 exceeds the target refrigerant level by a predetermined amount, the method proceeds to box 238, wherein valve 72 is opened while valve 74 is kept in the closed position, allowing excess or additional refrigerant in condenser 36 to flow into refrigerant vessel 70. Observing the liquid refrigerant level in evaporator 46 at box 236 again, if the liquid refrigerant level in evaporator 46 is lower than the target refrigerant level by a predetermined amount, the method proceeds to box 244, in which valve 74 is opened while valve 72 is kept in the closed position, causing additional refrigerant from refrigerant vessel 70 to flow into evaporator 46 and raise the liquid refrigerant level in evaporator 46.

Figure 6:
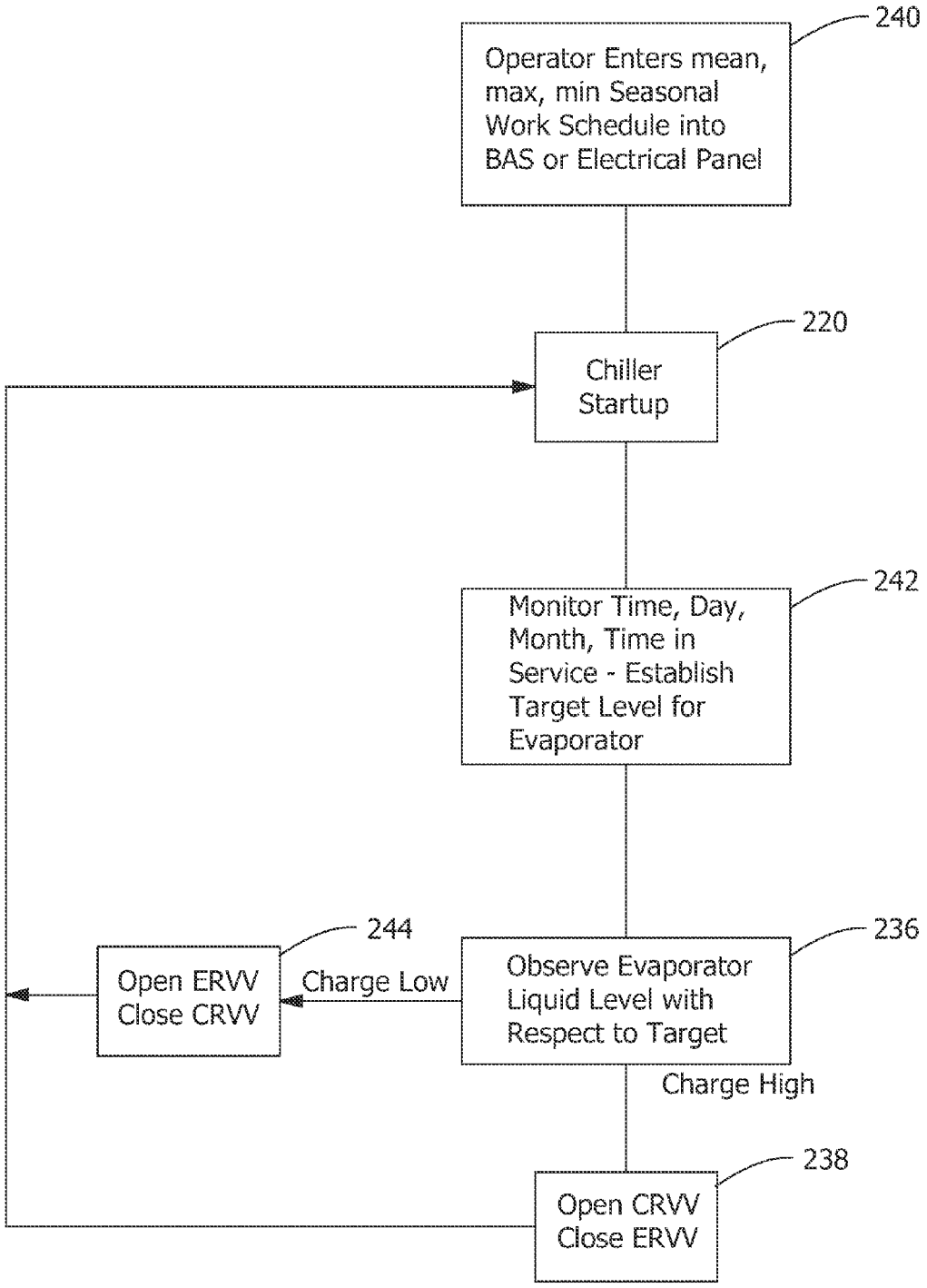
FIG. 6 illustrates an alternate exemplary embodiment of a control method for a site specific management of refrigerant charge in a chiller system.

Referring next to FIG. 6, another alternate embodiment of a control method is shown, for control of chiller system 15 using site specific parameters. At box 240, an operator enters site-specific data, e.g., mean chiller system capacity, maximum chiller system capacity, minimum chiller system capacity; or seasonal or weekly schedule, into BAS 170 or other electrical control panel 120. Next, at box 220, chiller system startup is initiated, and the system proceeds at box 242 to monitor data points such as the time, day, month and time in service, and based on the monitored data points the method establishes a target refrigerant level for liquid refrigerant in evaporator 46. Next, at box 236, the system observes the liquid refrigerant level in evaporator 46 with respect to the target refrigerant level previously established. If the liquid refrigerant level in evaporator 46 exceeds the target refrigerant level by a configurable amount, the method proceeds to box 238, wherein valve 72 is opened while valve 74 is kept in the closed position, allowing excess or additional refrigerant to flow from condenser 36 into refrigerant vessel 70. Observing the liquid refrigerant level in evaporator 46 at box 236 again, if the liquid refrigerant level in evaporator 46 is lower than the target refrigerant level by a predetermined amount, the method proceeds to box 244, in which valve 74 is opened while valve 72 is kept in the closed position, causing additional refrigerant to flow from refrigerant vessel 70 into evaporator 46 and raise the liquid refrigerant level in evaporator 46.

Figure 7:
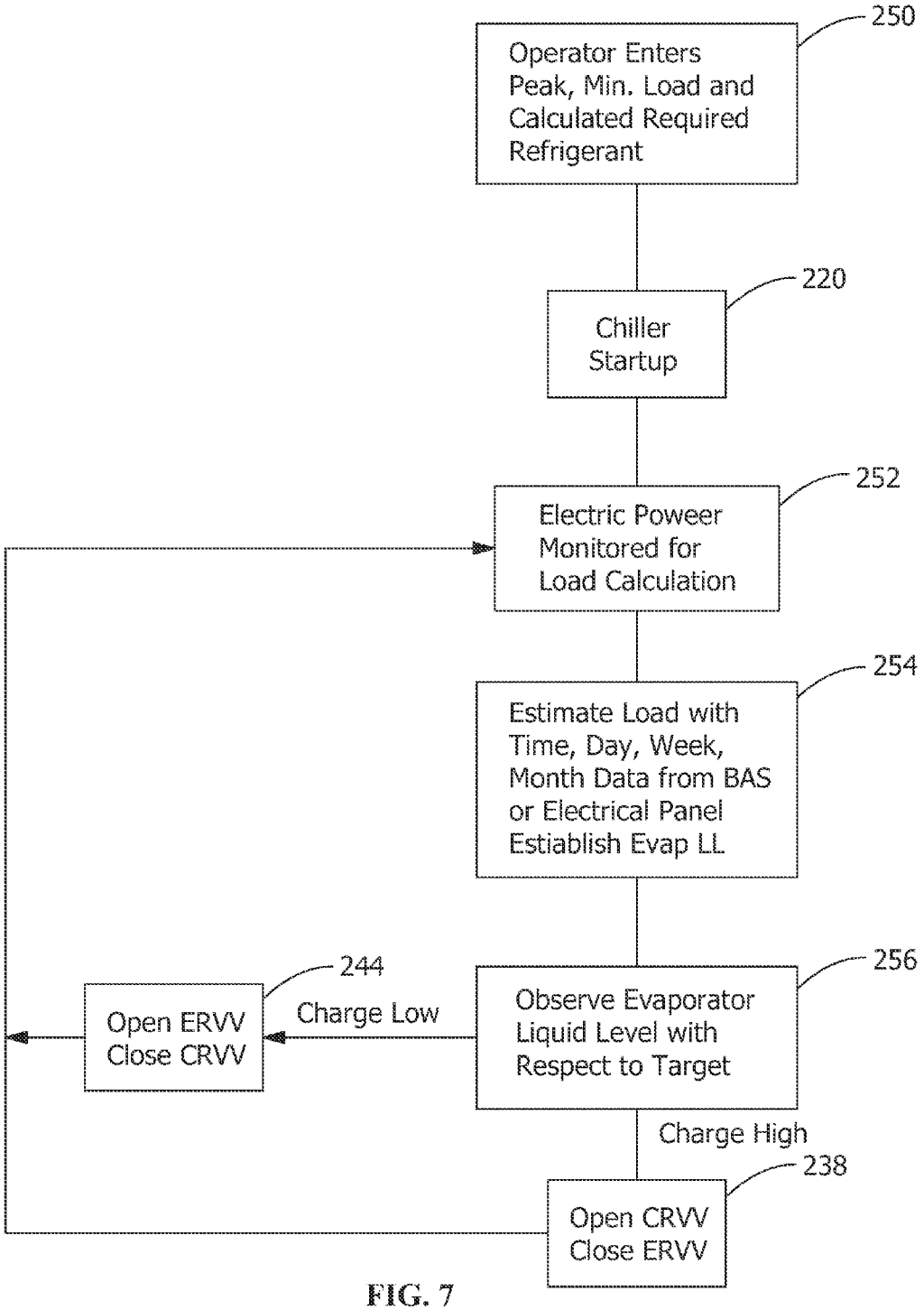
FIG. 7 illustrates an alternate exemplary embodiment of a control method for optimizing the refrigerant level in the evaporator of a chiller system.
Figure 8:
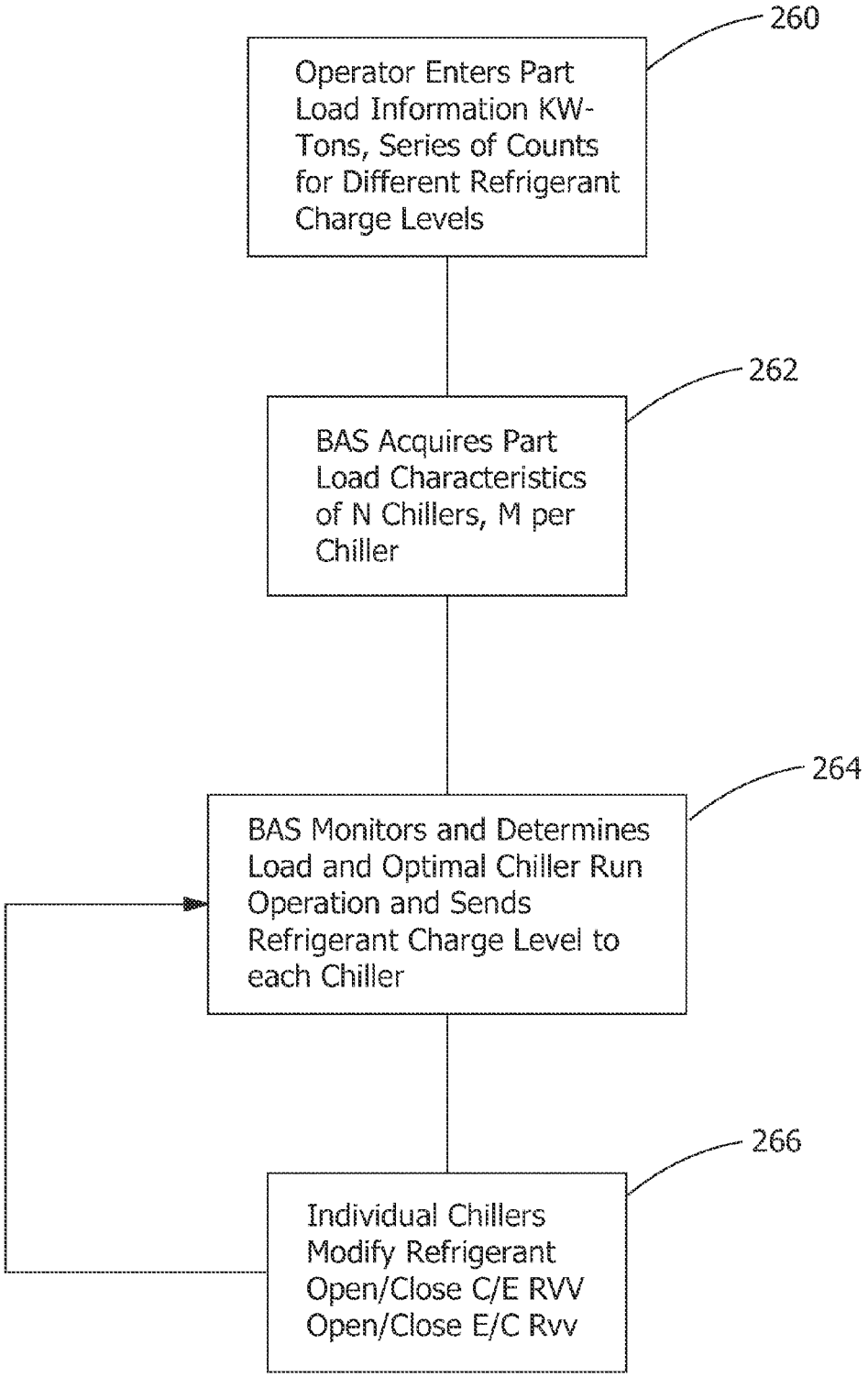
FIG. 8 illustrates an alternate exemplary embodiment of a control method for optimizing partial load operation in a multiple chiller system facility.

Referring next to FIG. 7, another alternate embodiment of a control method is shown, for optimizing the liquid refrigerant level of evaporator 46 based on an estimated load. At box 250, an operator enters peak load and minimum load parameters and calculates the required amount of refrigerant required to operate chiller system 15 (see, e.g., FIG. 3). The control method then proceeds to box 220, to start chiller system 15. Next, the control method proceeds to box 252 and monitors electrical control panel 120 to determine motor load associated with motor 56, and calculates the chiller system load 62. After calculating the chiller system load 62, the method proceeds at box 254 to estimate the chiller system capacity with the time, day, week and month data from BAS 170 or electrical control panel 120 to establish a target refrigerant level for liquid refrigerant in evaporator 46. Next, at box 236, the system observes the liquid refrigerant level in evaporator 46 with respect to the target refrigerant level previously established. If the liquid refrigerant level in evaporator 46 exceeds the target refrigerant level by a configurable amount, the method proceeds to box 238, wherein valve 72 is opened while valve 74 is kept in the closed position, allowing excess or additional refrigerant to flow from condenser 36 into refrigerant vessel 70, thereby lowering the liquid refrigerant level in evaporator 46. If, however, the liquid refrigerant level in evaporator 46 is lower than the target liquid refrigerant level by a predetermined amount, the method proceeds to box 244, in which valve 74 is opened while valve 72 is kept closed, causing additional refrigerant to flow from refrigerant vessel 70 into evaporator 46 and raise the liquid refrigerant level in evaporator 46. Referring next to FIG. 8, another alternate embodiment of a control method is shown, for optimizing a multiple-unit chiller plant for partial load operation. Beginning at box 260, an operator enters partial load information in units of kilowatts or tons of cooling capacity, and a series of curves for efficient refrigerant change levels. Next the method proceeds to box 262, and BAS 170 acquires partial load characteristics for N chillers, M curves per chiller. The method then proceeds to box 264, wherein BAS 170 monitors chiller system load 62 and determines optional chiller operation, including an evaporator refrigerant level for each of the chiller units that make up the chiller plant. The BAS 170 transmits the determined evaporator refrigerant level to each chiller control panel 120. Next, the method proceeds at box 266 to modify evaporator refrigerant levels for each individual chiller by opening and closing valves 72, 74, according to one or more of the control methods set forth above with respect to FIGS. 4-7.

Refrigerant vessel 70 may also provide a temporary refrigerant storage capacity when performing maintenance or repairs on chiller system 15. If necessary to drain chiller system 15 of refrigerant, e.g., to make repairs to condenser 36, refrigerant 100 may be transferred from condenser 36 via valve 72 into refrigerant vessel 70, where the refrigerant 100 may maintained by closing both valves 72 and 74 during the maintenance or repair operations. When ready to resume operation, refrigerant 100 may be replaced into chiller system via valve 74 to evaporator 46.

While only certain features and embodiments of the disclosure have been shown and described, many modifications and changes may occur to those skilled in the art (for example, variations in sizes, dimensions, structures, shapes and proportions of the various elements, values of parameters (for example, temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. Furthermore, in an effort to provide a concise description of the exemplary embodiments, all features of an actual implementation may not have been described (i.e., those unrelated to the presently contemplated best mode of carrying out the disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

As noted above, embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

The invention claimed is:

1. A refrigeration system comprising:

a compressor, a condenser, an expansion device, an evaporator, and an additional refrigerant vessel connected in a closed refrigerant loop;

the additional refrigerant vessel connected to the condenser at a high pressure side by a first valve and to the evaporator at a low pressure side by a second valve;

a controller to control operation of the first valve and the second valve, wherein only one of the first valve and the second valve is open at a time to allow additional refrigerant to be added to the closed refrigerant loop in response to the controller receiving a low refrigerant level indication of a refrigerant level in the evaporator, or to remove refrigerant from the closed refrigerant loop in response to the controller receiving a high refrigerant level indication of a refrigerant level in the evaporator, a chamber in fluid communication with the evaporator; and a fluid level sensor disposed within the chamber to provide a direct measurement of the refrigerant level to the controller;

the controller configured to:

count the number of surges occurring within a predetermined interval;

increment a surge count when a surge is indicated;

compare the surge count with a surge count threshold; and in response to the surge count exceeding the surge count threshold:

observe a liquid refrigerant level in the evaporator with respect to a target refrigerant level; and in response to observing no change in the liquid refrigerant level over the predetermined interval, return to the step of monitoring a parameter associated with the compressor and monitor a motor current for surge indication.

2. The refrigeration system of claim 1, wherein only one of the first valve and the second valve may be open between the additional refrigerant vessel and the condenser or the evaporator.

3. The refrigeration system of claim 1, wherein the additional refrigerant vessel is connected to the expansion valve line and the expansion valve line is connected to the condenser by a first line and to the evaporator by a second line.

4. The refrigeration system of claim 1, wherein the controller determines an amount of additional refrigerant to be used in the additional refrigerant vessel based on a total refrigerant charge comprising the sum of a condenser refrigerant charge, an evaporator refrigerant charge, and system piping refrigerant charge.

5. The refrigeration system of claim 4, wherein the controller computes the evaporator refrigerant charge by the equation:

$$\text{Charge}_{evap}=LF_{evap}\times\rho_{liq.evap}\times\text{Volume}_{evap}$$

Where:

($\text{Charge}_{evap}$)=the refrigerant charge in the evaporator ($\text{LF}_{evap}$)=the loading factor of the evaporator ($\rho_{liq.evap}$)=by the fluid density of the evaporator ($\text{Volume}_{evap}$)=by the volume of the evaporator.

6. The refrigeration system of claim 4, wherein the controller computes the condenser refrigerant charge by the equation:

$$\text{Charge}_{cond}=\rho_{liq.cond}\times\text{Vol}_{sub}+\rho_{cond.equiv}\times\text{Vol}_{cond}$$

where:

($\text{Charge}_{cond}$)=the refrigerant charge in the condenser ($\rho_{liq.cond}$)=the fluid density of liquid in the condenser ($\text{Vol}_{sub}$)=the volume of the liquid in the subcooler ($\rho_{cond.equiv}$)=equivalent fluid density in the condenser and ($\text{Vol}_{cond}$)=the volume of fluid the condenser.

7. The refrigeration system of claim 4, wherein the controller computes the system piping refrigerant charge by the equation:

$$\text{Charge}_{piping}=F_{piping}\times(\text{Charge}_{evap}+\text{Charge}_{cond})$$

where:

($\text{Charge}_{piping}$)=the refrigerant charge in the system piping ($\text{F}_{piping}$)=factor (%) of refrigerant charge in the system piping ($\text{Charge}_{evap}$)=the charge in the evaporator and ($\text{Charge}_{cond}$)=the refrigerant charge in the condenser.

8. The refrigeration system of claim 4, wherein the controller computes a total system refrigerant charge by the equation:

$$\text{Charge}_{total}=\text{Charge}_{evap}+\text{Charge}_{cond}+\text{Charge}_{piping}$$

where:

$\text{Charge}_{total}$=the total system refrigerant ($\text{Charge}_{evap}$)=the refrigerant charge in the evaporator ($\text{Charge}_{cond}$)=the refrigerant charge in the condenser ($\text{Charge}_{piping}$)=the refrigerant charge in the system piping.

9. The refrigeration system of claim 7, wherein the factor (%) of refrigerant charge in the system piping is approximately 13% of the sum of the evaporator refrigerant charge and the condenser refrigerant charge.

10. The refrigeration system of claim 7, wherein the total system refrigerant charge is used to determine an amount of refrigerant to add to the refrigerant vessel.

11. A refrigeration system comprising:

a compressor, a condenser, an expansion device, an evaporator, and an additional refrigerant vessel connected in a closed refrigerant loop;

the additional refrigerant vessel connected at an inlet to an expansion valve inlet line from the condenser, and at an outlet to an expansion valve outlet line from the evaporator; and a controller configured to control operation of a first valve and a second valve, wherein only one of the first valve and the second valve may open at any time to allow refrigerant from the additional refrigerant vessel to be added to the closed refrigerant loop in response to the controller receiving a low refrigerant level indication of a refrigerant level in the evaporator, or to remove refrigerant from the closed refrigerant loop in response to the controller receiving a high refrigerant level indication of a refrigerant level in the evaporator, a chamber in fluid communication with the evaporator; and a fluid level sensor disposed within the chamber to provide a direct measurement of the refrigerant level to the controller;

the controller configured to:

count the number of surges occurring within a predetermined interval;

increment a surge count when a surge is indicated;

compare the surge count with a surge count threshold; and in response to the surge count exceeding the surge count threshold:

observe a liquid refrigerant level in the evaporator with respect to a target refrigerant level; and in response to observing no change in the liquid refrigerant level over the predetermined interval, return to the step of monitoring a parameter associated with the compressor and monitor a motor current for surge indication.

12. The refrigeration system of claim 11, wherein the controller maintains a plurality of selected parameters of the closed refrigerant loop within preselected ranges.

13. The refrigeration system of claim 12, wherein the plurality of selected parameters comprises: an input valve position, an output valve position, a fluid level in the refrigerant vessel, a fluid level in condenser, or a fluid level in evaporator.

14. The refrigeration system of claim 13, wherein the controller employs continuous feedback from a plurality of sensors monitoring the respective selected parameters to continuously monitor and change the amount of refrigerant in the refrigeration system in response to changes in system cooling loads.

15. The refrigeration system of claim 14, wherein the refrigerant level in the closed refrigerant loop can be varied by opening or closing the first valve or the second valve, and a capacity control device is correspondingly updated or revised in response to changes in cooling capacity capabilities resulting from the modified refrigerant level.

16. A method for controlling cooling capacity of a chiller system having a compressor, a condenser and an evaporator connected in a closed refrigerant loop, the method comprising:

providing a refrigerant vessel for a chiller system;

connecting the refrigerant vessel and an outlet line from the refrigerant vessel to the evaporator;

connecting an inlet line to the refrigerant vessel to the condenser, the inlet line including a first valve to control flow of refrigerant in the inlet line and the outlet line including a second valve to control flow of refrigerant in the outlet line;

monitoring a parameter associated with the compressor for indication of a surge condition in the chiller system;

in response to receiving an indication of an impending surge condition, directly observing a refrigerant liquid level in the evaporator with respect to surge indication frequency, and adjusting the capacity of the chiller system in response to a change in the refrigerant liquid level in the evaporator, a chamber in fluid communication with the evaporator; and a fluid level sensor disposed within the chamber to provide a direct measurement of the refrigerant level to the controller;

counting the number of surges occurring within a predetermined interval;

incrementing a surge count when a surge is indicated;

comparing the surge count with a surge count threshold; and in response to the surge count exceeding the surge count threshold:

observing a liquid refrigerant level in the evaporator with respect to a target refrigerant level; and in response to observing no change in the liquid refrigerant level over the predetermined interval, returning to the step of monitoring a parameter associated with the compressor and monitoring a motor current for surge indication.

17. The method of claim 16, wherein the parameter is a motor current flowing in a compressor motor.

18. The method of claim 16, wherein the step of adjusting the capacity comprises:

in response to an increase in the refrigerant liquid level in the evaporator with respect to instances of surge indications over a predetermined period, opening the first valve to allow refrigerant to flow from the condenser into the refrigerant vessel to decrease the cooling capacity of the chiller system.

19. The method of claim 18, wherein the step of adjusting the capacity further comprises:

in response to a decrease in the refrigerant liquid level in the evaporator with respect to instances of surge indications over a predetermined period, opening the second valve to allow refrigerant to flow from the refrigerant vessel into the evaporator to increase the cooling capacity of the chiller system.

* * * * *